US007793645B2

(12) United States Patent
Walk et al.

(10) Patent No.: US 7,793,645 B2
(45) Date of Patent: Sep. 14, 2010

(54) VIBRATION DAMPENING APPARATUS

(75) Inventors: Randy J. Walk, Erda, UT (US); Jason L. Fogg, Tooele, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 365 days.

(21) Appl. No.: 11/247,572

(22) Filed: Oct. 11, 2005

(65) Prior Publication Data

US 2007/0079821 A1 Apr. 12, 2007

(51) Int. Cl.
*F41B 5/20* (2006.01)

(52) U.S. Cl. ..... 124/89; 188/378; 267/136

(58) Field of Classification Search ..... 124/89; 188/268, 378, 379; 267/136
See application file for complete search history.

(56) References Cited

U.S. PATENT DOCUMENTS

| | | | | |
|---|---|---|---|---|
| 3,342,172 | A * | 9/1967 | Sanders | 124/23.1 |
| 3,670,712 | A | 6/1972 | Izuta | |
| 4,005,858 | A | 2/1977 | Lochmer | |
| 4,085,832 | A | 4/1978 | Gaines et al. | |
| 4,570,608 | A | 2/1986 | Masterfield | |
| 4,706,788 | A | 11/1987 | Inman et al. | |
| 4,893,606 | A | 1/1990 | Sisko | |
| 5,016,602 | A | 5/1991 | Mizek | |
| 5,273,022 | A | 12/1993 | Leven | |
| 5,339,793 | A | 8/1994 | Findley | |
| 5,595,168 | A | 1/1997 | Martin | |
| 5,992,403 | A * | 11/1999 | Slates | 124/89 |
| 6,085,736 | A * | 7/2000 | Osterhues | 124/89 |
| 6,298,842 | B1 | 10/2001 | Sims | |
| 6,526,957 | B1 * | 3/2003 | Leven | 124/89 |
| 6,588,414 | B2 | 7/2003 | McMillan, III | |
| 6,675,793 | B1 | 1/2004 | Saunders | |
| 6,712,059 | B2 | 3/2004 | Donovan | |
| 6,718,964 | B1 | 4/2004 | Graf | |
| 2002/0020403 | A1 * | 2/2002 | Troubridge | 124/89 |
| 2002/0162547 | A1 | 11/2002 | McMillan, III | |
| 2003/0094168 | A1 | 5/2003 | Sims | |
| 2003/0226556 | A1 | 12/2003 | Leven | |
| 2004/0107952 | A1 | 6/2004 | Kronfeld | |

* cited by examiner

*Primary Examiner*—John Ricci
(74) *Attorney, Agent, or Firm*—Holland & Hart

(57) ABSTRACT

Apparatuses and structures for dampening vibrational energy from a system are disclosed. Particularly, at least one dampening member including an elongated body comprising a resilient, pliable material may be coupled to the base via at least one coupling structure structured for coupling at least a portion of the elongated body of the at least one dampening member to the dampening apparatus. Such a structure or dampening apparatus may be incorporated or attached to an archery system. Specifically, an archery system or an archery accessory component (e.g., a quiver or sight) may include at least one dampening member including a elongated body comprising a resilient, pliable material and at least one coupling structure structured for accepting at least a portion of the elongated body of the at least one dampening member so as to couple the at least one dampening member to the archery bow or component thereof.

41 Claims, 12 Drawing Sheets

VIBRATION DAMPENING APPARATUS

TECHNICAL FIELD OF THE INVENTION

The present invention relates to dampening devices for archery bows and archery accessories.

BACKGROUND OF THE INVENTION

Impact-induced vibrations result when using many types of equipment, including archery bows and related archery equipment. An oscillating system typically vibrates with respect to at least one resonant frequency (e.g., for each degree of freedom of the system). In addition, an oscillating system may also vibrate at harmonics of the resonant frequency (i.e., twice the resonance frequency, four times the resonance frequency, etc.). Of course, an oscillating system may also vibrate, to a lesser extent, at other frequencies as may be excited therein. The resonant frequency of a system may be generally proportional to a constant, commonly referred to as the spring constant or spring coefficient and to the mass of the system. An oscillating system may also have an internal damping factor associated therewith which dampens or diminishes, over time, the amplitude of the oscillations. However, among other reasons, because archery bows are preferentially light to make the archery bow easier to carry and shoot and relatively stiff, such internal dampening may be relatively minute or ineffective for dampening vibrations of a bow system.

Relative to archery systems, when an arrow is launched from an archery bow, the bow may be described as an oscillating system. For example, in anticipation of shooting an arrow at an intended target, an archer nocks an arrow on the bowstring and draws an archery bow. Drawing the bowstring stores potential energy in the bow limbs. When the bowstring is released, most of the stored potential energy is transferred to the arrow, causing the arrow to fly according to the magnitude and direction of the force imparted to the arrow. Generally, at least some portion of the potential energy is not transferred to the arrow, but instead absorbed by the bow. Ideally, if all of the stored energy were transferred to the arrow, or were otherwise dissipated or stored, the bow would not vibrate after release of the arrow. Due to the physics, mechanics, and dynamics of the bow and the arrow system configuration, such vibration may be difficult, if not impossible, to eliminate completely.

Accordingly, a recoil or kick, in combination with attendant vibration, may be felt by the archer. Such vibrations inevitably result in problems for the bow hunter or archer. Specifically, such vibrations give rise to undesirable noise, may influence accuracy in shooting, may cause physical discomfort to the archer's hand and arm, and may cause undesirable wear and tear on the archery bow and string.

Dampening devices have been used in many ways to reduce vibrations in archery bows. One conventional approach for lessening the effects of archery bow system vibration has been to use dampening devices in combination with stabilizers. Stabilizers with dampening material incorporated therein are mounted to the bow riser and are designed to reduce torque and absorb vibration generated upon release of an arrow. Mechanical dampers incorporated into stabilizers are also used to reduce bow vibrations.

In addition, dampening devices have been mounted to other areas of the bow, including the riser, the limbs, and the bowstring. In one type of conventional mechanical damper, a metal cylinder may be filled with oil and a piston in the cylinder is allowed to travel back and forth within the oil-filled cylinder to dampen vibrations. A third type of bow stabilizer is a rod and mass system. Rod and mass stabilizers include a system of movable weights to tune the stabilizer resonant frequency to that of the natural frequency of the system.

Accordingly, it would be advantageous to provide improved dampening apparatuses and structures for dampening vibrations of archery bows and archery accessories. Although the above-discussion references archery systems, the present invention may also relate to other systems that may experience vibration.

SUMMARY OF THE INVENTION

One aspect of the present invention relates to an apparatus for dampening vibrational energy from a system. Particularly, at least one dampening member may be coupled to a base. For example, a base may extend between a first end and a second end thereof and the first end may include an attachment mechanism for affixing the dampening member to a system. In addition, at least one dampening member including an elongated body comprising a resilient, pliable material may be coupled to the base via at least one coupling structure structured for coupling at least a portion of the elongated body of the at least one dampening member to the base.

Another aspect of the present invention relates to a structure for dampening vibrational energy from an archery system. For example, such a structure may include at least one dampening member including a elongated body comprising a resilient, pliable material and at least one coupling structure structured for coupling at least a portion of the elongated body of the at least one dampening member to a component of an archery system. Further, the at least one dampening member may be coupled to the archery system via the at least one coupling structure.

Another aspect of the present invention relates to an archery dampening system. Specifically, an archery bow or an archery accessory may include at least one dampening member including a elongated body comprising a resilient, pliable material and at least one coupling structure structured for accepting at least a portion of the elongated body of the at least one dampening member so as to couple the at least one dampening member to the archery bow or archery accessory. Further, the at least one dampening member may be coupled to the archery bow via the at least one coupling structure.

Features from any of the above mentioned embodiments may be used in combination with one another in accordance with the present invention. In addition, other features and advantages of the present invention will become apparent to those of ordinary skill in the art through consideration of the ensuing description, the accompanying drawings, and the appended claims.

DETAILED DESCRIPTION OF THE INVENTION

Generally, the present invention relates to an apparatus for dampening vibrations of a system. In further detail, the present invention relates to an apparatus carrying least one elongated dampening member comprising a pliable, resilient material. Such an apparatus may provide dampening to a system. Also, the apparatus may be configured for selectively affixing to or removing from, respectively, a system. In one embodiment, the dampening apparatus is secured to an archery system.

Figure 1B:
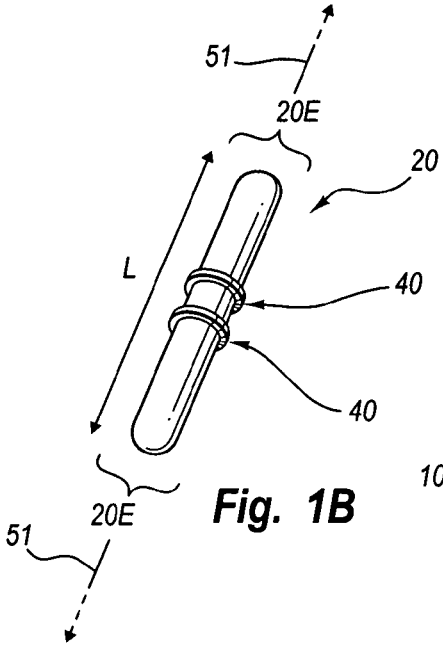
FIG. 1B shows a perspective view of an embodiment of a dampening member of the present invention.
Figure 1A:
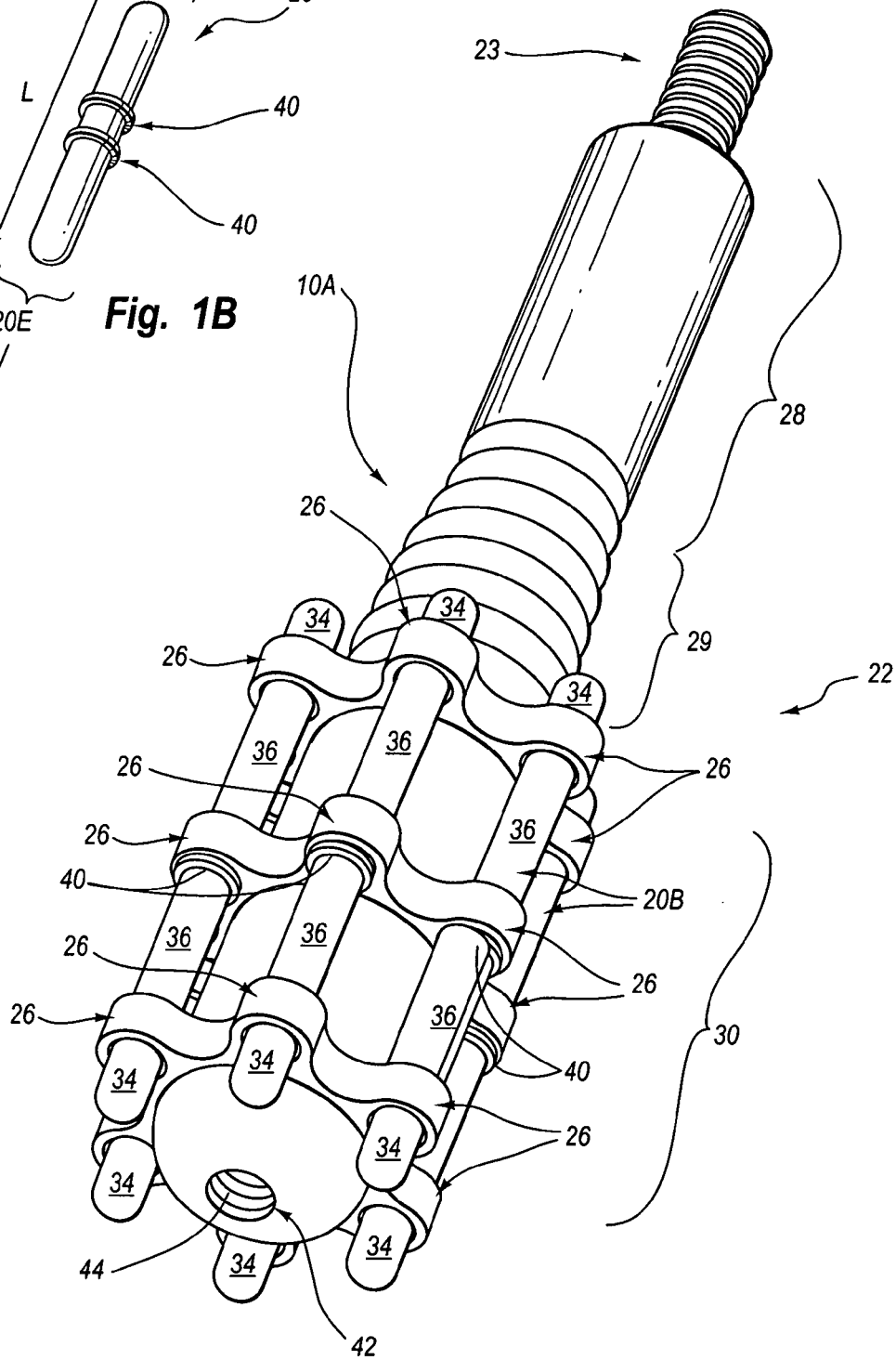
FIG. 1A shows a perspective view of a dampening apparatus of the present invention including a plurality of dampening members.
Figure 1C:
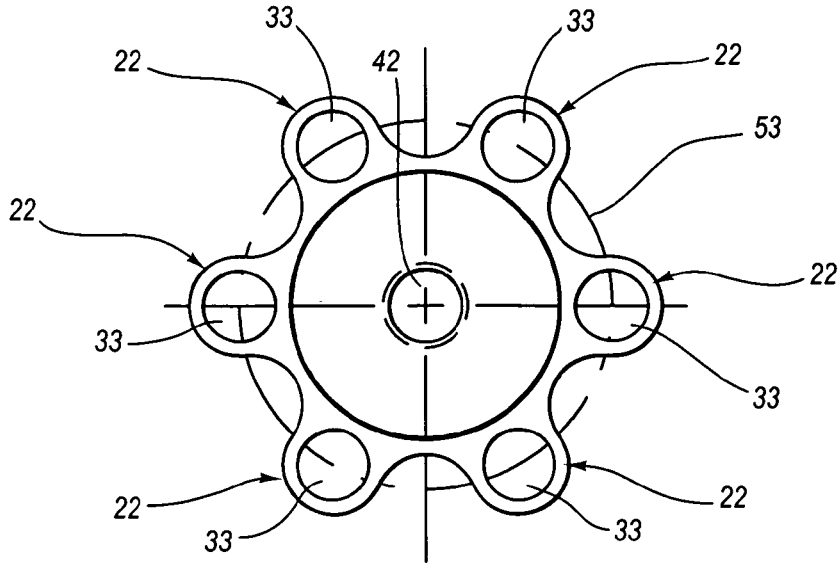
FIG. 1C shows a top elevation view of the body of the dampening apparatus as shown in FIG. 1A.
Figure 1D:
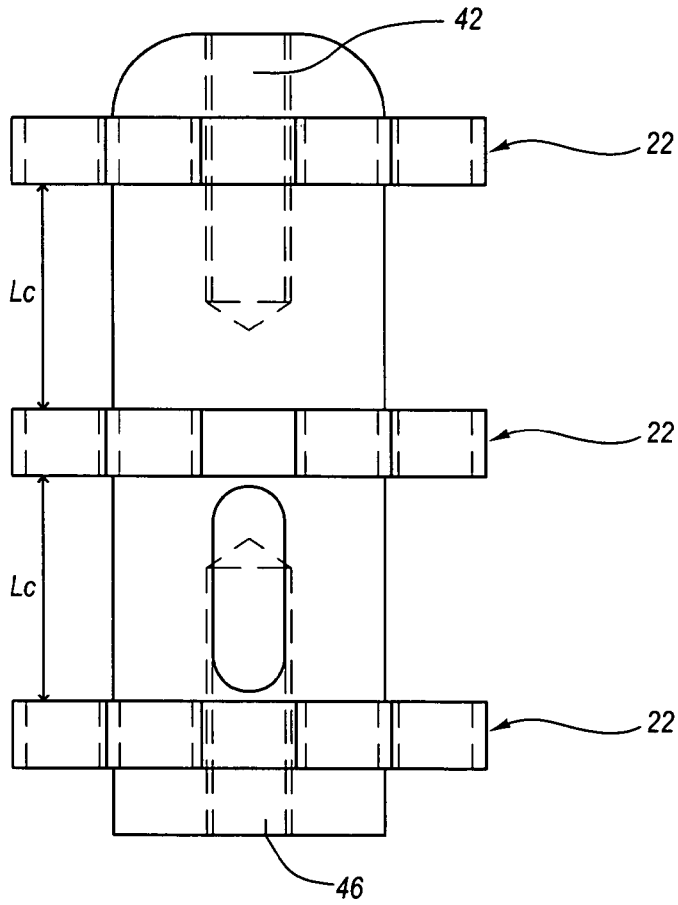
FIG. 1D shows a side schematic view of the body of the dampening apparatus shown in FIGS. 1A and 1B.

FIG. 1A shows a perspective view of one embodiment of an archery accessory apparatus 10A of the present invention including a plurality of dampening apparatuses or members 20B. Specifically, the apparatus 10A shown in FIG. 1 is a stabilizer. FIGS. 1C and 1D show a top elevation view and a side schematic view of the base 22 as shown in FIG. 1A. More particularly, base 22 may extend between a mounting region 28 and a region 30 configured for carrying the plurality of dampening apparatuses or members 20B. As shown in FIG. 1A, base 22 may optionally include a transition region 29 extending between the mounting region 28 and region 30, which may comprise a pliant, resilient material, such as rubber or silicone. Thus, transition region 29 (shown as having a ribbed exterior surface) may comprise a flexible joint. Such a configuration may provide dampening ability to apparatus 10A, since region 30 (e.g., a mass or rotational inertia), may cause transition region 29 to bend, twist, or otherwise dampen vibrational energy in response to vibrational energy communicated thereto.

Also, as shown in FIG. 1A, base 22 may be generally elongated. Mounting region 28 may be configured for affixing the apparatus 10A to a system. In one embodiment, the apparatus 10A is coupled to an archery system. "Archery system" means any archery bow or archery bow component, or any archery accessory, including without limitation sights, quivers, stabilizers, and arrow rests. "Archery accessory" means anything that can be attached to an archery bow. For instance, mounting region 28 of base 22 may include an affixation element 23 which may comprise, as shown in FIGS. 1A and 1C, for instance, a threaded bolt. In another embodiment, affixation element 23 may comprise a threaded recess, a pin, or any other affixation element as known in the art for affixing the apparatus 10A (FIG. 1C) to a system. Mounting region 28 and region 30 of base 22 may comprise a substantially rigid material such as a metal, a plastic, a urethane, or another relatively rigid material as known in the art.

Also, a plurality of elongated dampening apparatuses or members 20B may be positioned along the body of a base 22, wherein each of the plurality of dampening members 20B is supported by a plurality of coupling structures 26.

Dampening member 20 of apparatus 10A may be positioned proximate the region 30 of base portion 22 as shown in FIG. 1A. For clarity, dampening apparatus or member 20 is shown in a perspective view in FIG. 1B. As shown in FIG. 1B, dampening member 20 may comprise an elongated body 20B extending between two end regions 20E and having a length L. Elongated, as used herein, means having a length that is at least two times larger than a maximum cross-sectional dimension (e.g., a diameter). Elongated body portion 20B may have a substantially constant cross-sectional shape that extends along longitudinal axis 51 (i.e., a reference axis that is positioned along the center of the cross-section of the elongated body portion 20B) of the elongated body portion 20B. The longitudinal axis 51 of the elongated body portion 20B may extend along at least one straight line or may extend along at least one accurate path, without limitation.

The present invention contemplates that the size, shape, length, material, and structure of a dampening apparatus or member 20 may be selected to effectively dampen vibrations. More particularly, dampening member 20 may comprise a material such as a rubber, a silicone, or another pliable, resilient material as known in the art. In one embodiment, the dampening members 20, 20B (FIGS. A and 1B) comprise NAVCOM™ manufactured by Sims Vibration Laboratory. Such a dampening apparatus or member 20 may exhibit an elongated body having a cross section that may be substantially circular, substantially elliptical, substantially quadrilateral, substantially triangular, or generally polygonal, without limitation. It may be appreciated that a dampening characteristic of a dampening member 20 may be at least partially dependent upon its dimensions and material comprising same, and the nature of its mechanical coupling to base 22.

Dampening apparatus or member 20 may be coupled to the base portion 22 via at least one coupling structure 26. Coupling structure 26 may comprise any mechanism for affixing dampening member 20 to base 22 as known in the art, such as for instance, a key and groove or a dove tail configuration, a mating recess and protrusion, or a geometry that at least partially surrounds the dampening member 20. In one example, coupling structure 26 may comprise a geometry that at least partially surrounds a peripheral portion of the dampening member 20 so as to mechanically couple the dampening member 20 to the base 22. As shown in FIGS. 1A and 1D, a coupling structure 26 may circumferentially completely surround a portion of a periphery of a dampening member 20. Also, dampening member 20 and coupling structure 26 may be sized and configured so as to position the dampening member 20 with respect to the coupling structure 26. In one example, the coupling structure 26 may be smaller in some respect than the dampening member 20. Thus, positioning of the dampening member 20 within the coupling structure 26 may result in an interference fit caused by compression, pinching, or otherwise constraining of the associated dampening member 20 within structure 26. Also, although dampening member 20 may be described as elongated, the dampening member 20 may include other features such as recesses, protrusions, or other features. Such features may be configured for enhancing vibration dampening or may facilitate affixing of the dampening member 20 to the base 22 via a coupling structure 26.

Further, as shown in FIG. 1B, each of the dampening members or apparatuses 20B may include two raised ribs that function as retaining elements 40 for positioning a dampening member 20B with respect to one or more of the coupling structures 26 and retaining the dampening member 20B in a selected position, as discussed in greater detail hereinbelow. Further, as shown in FIG. 1C, raised ribs or retaining elements 40 of dampening members 20B may be positioned with respect to one another so that one raised retaining element 40 may be positioned on one side of a coupling structure 26 and another raised retaining element 40 may be positioned on another side of the coupling structure 26. Thus, when dampening member 20B is coupled to coupling structure 26, at least one raised retaining element 40 may resist movement of the dampening member 20B in a first longitudinal direction (i.e., along longitudinal axis 51), while at least one raised retaining element 40 may resist movement of the dampening member 20B in an opposite longitudinal direction (i.e., along longitudinal axis 51).

Accordingly, in the embodiment shown in FIGS. 1A-1D, coupling structures 26 may comprise, with respect to each dampening member 20B, a plurality of substantially coaxially aligned, substantially cylindrical apertures 33 for supporting a dampening member 20B positioned therein. Thus, the plurality of dampening members 20B may be substantially equally circumferentially spaced (as shown with respect to reference bolt circle 53) about region 30. In addition, a longitudinal axis (i.e., longitudinal axis 51 as shown in FIG. 1B) of each of dampening members 20B may be substantially parallel to each other longitudinal axes of the plurality of dampening members 20B.

Also, coupling structures 26 may be positioned with respect to one another and separated by distances labeled "Lc," (shown in FIG. 1D). Distance Lc between adjacent coupling structures 26 may be chosen so as to cause the dampening member 20B to exhibit a selected vibration-dissipating characteristic (e.g., at least one natural frequency). Thus, dampening members 20B may be pulled through or otherwise coupled to a coupling structure 26. Of course, a size, shape, length, material, and structure of a dampening member 20B may be selected according to the desired dampening. Further, as shown in FIGS. 1A-1D, a central recess 42 may be formed within base 22 and a dampening member 44 may be positioned therein. Also, recess 46 may be structured for affixing transition region 29 to end region 30.

Figure 1E:
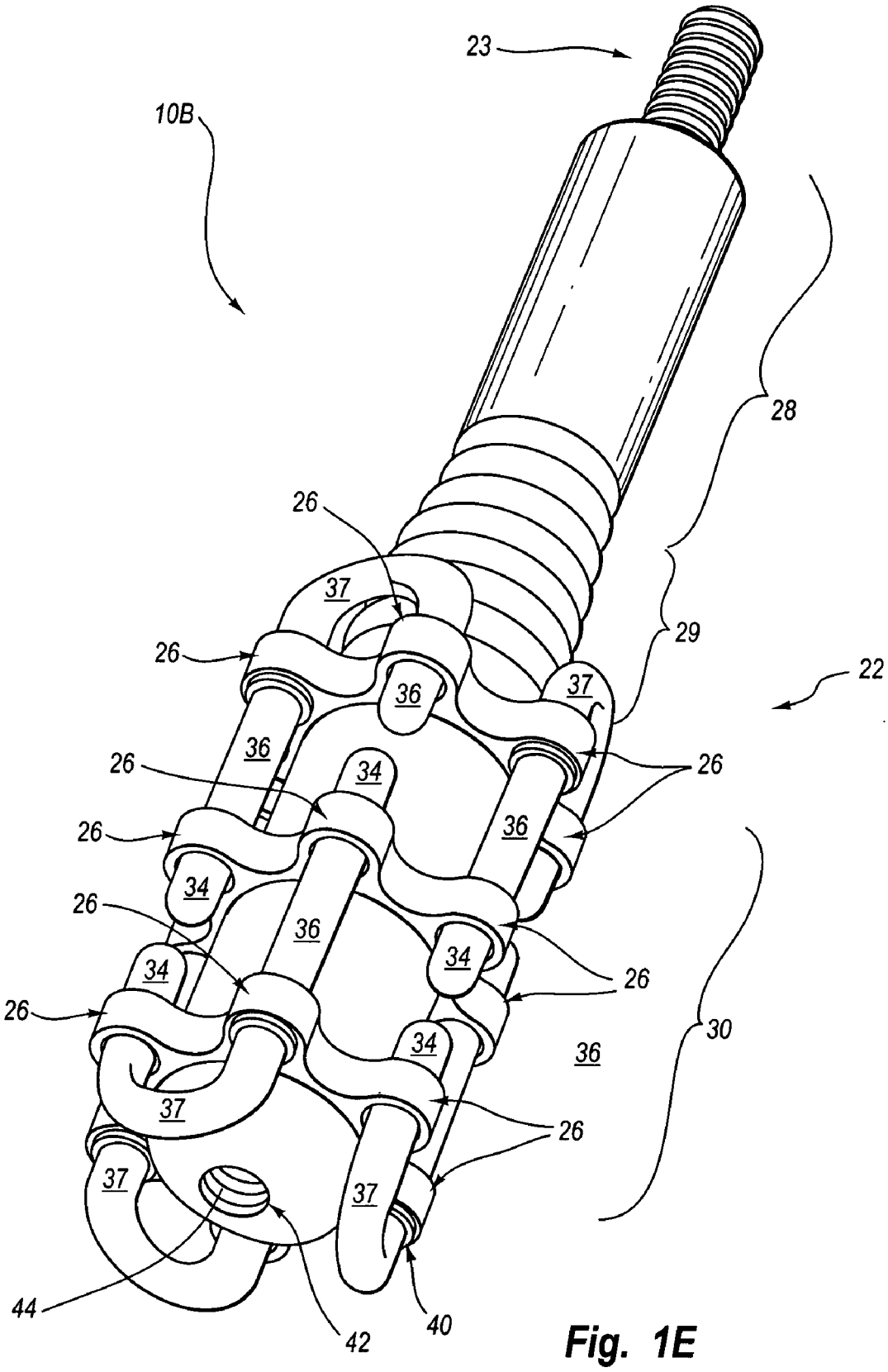
FIG. 1E shows a perspective view of yet another embodiment of a dampening apparatus of the present invention wherein at least a portion of one of the plurality of dampening members extends accurately.

In yet a further aspect of the present invention, a single configuration of coupling structures 26 may allow for a multitude of different dampening member 20B configurations. In one example, as shown in FIG. 1E, dampening apparatus 10B may include dampening members 20B that accurately or otherwise extend between circumferentially adjacent coupling structures 26 forming connection regions 37. As will be understood, middle regions 36 and end regions 34 may be formed, as shown in FIG. 1D. Thus, a longitudinal axis of a dampening member 20B may extend along a path between coupling structures 26 or therein. In such a configuration, a dampening member 20B, when unconstrained, may have an elongated body that extends along the path. In one embodiment, the path may be accurate. In another embodiment, a dampening member 20B may be substantially straight when unconstrained, but may be biased or held in a path by way of at least one coupling structure 26.

The present invention further contemplates that a dampening apparatus of the present invention may include a single elongated dampening member that is coupled to a base of the dampening apparatus by a plurality of coupling structures. In one embodiment, a single dampening member may extend through coupling structures so as to at least partially surround an exterior of a region of a dampening apparatus. Of course, such a single dampening member may include substantially straight sections or regions and may include accurate sections or regions in extending around at least a portion of a dampening apparatus of the present invention. Such an embodiment may provide different damping characteristics as compared to the embodiment shown in FIGS. 1A or 1D, at least partially due to the difference in configuration (e.g., support and constraint) of dampening members. Thus, a single coupling structure configuration may be utilized to form a plurality of different dampening apparatus configurations, depending on the specific at least one dampening member and configuration thereof. Such flexibility may be beneficial for providing a dampening apparatus with adjustable damping characteristics. Thus, a dampening characteristic of a dampening apparatus of the present invention may be selectively changed or adjusted by replacing or modifying the dampening member configuration thereof.

While one embodiment of the present invention is described above with respect to FIGS. 1A-1C, the present invention is not so limited. Rather, the present invention may encompass generally at least one elongated dampening apparatus or member coupled to any archery system to dampen vibrations of such a system. "Archery system" means an archery bow or archery bow component, or any archery accessory, including without limitation sights, quivers, arrow rests, and stabilizers. "Archery accessory" means anything that can be attached or used with an archery bow.

Figure 2A:
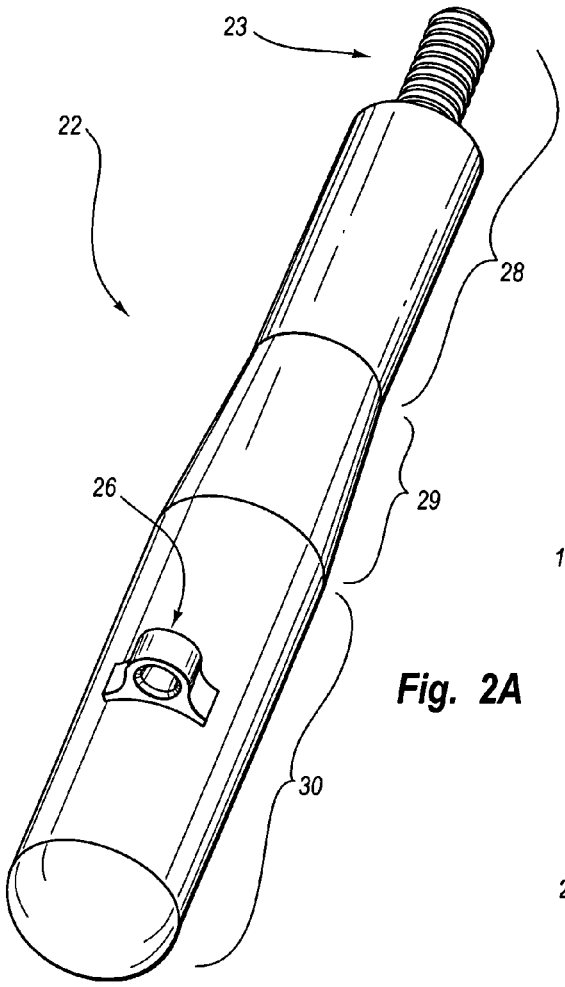
FIG. 2A shows a perspective view of another embodiment of a body of a dampening apparatus of the present invention.
Figure 2B:
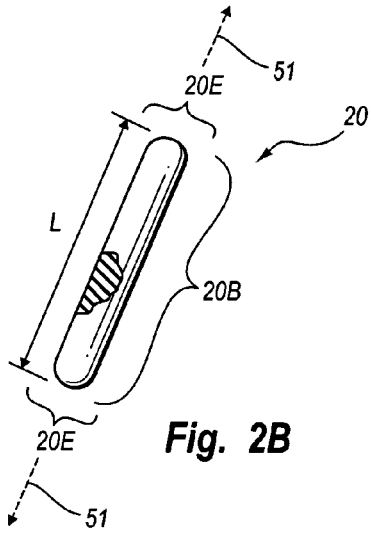
FIG. 2B shows a perspective view of another embodiment of a dampening member of the present invention.
Figure 2C:
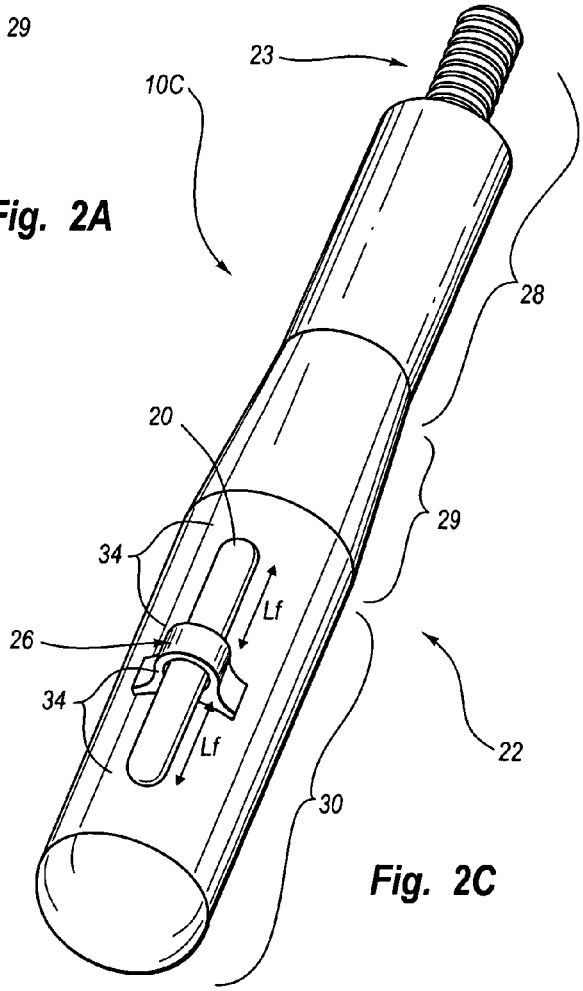
FIGS. 2C shows a perspective view of one embodiment of a dampening apparatus of the present invention.

FIGS. 2A-2C illustrate additional aspects of the present invention. FIG. 2C shows a perspective view of one embodiment of an apparatus 10C of the present invention including at least one dampening apparatus or member 20 coupled thereto via coupling structure 26. As shown in FIG. 2A, base 22 may optionally include a transition region 29 extending between the mounting region 28 and region 30, which may comprise a rigid material, such as a material comprising base 22.

As shown in FIG. 2C, the length L (FIG. 1B) of dampening apparatus or member 20 may be substantially centered about coupling structure 26. Put another way, as shown in FIG. 1C, a length Lf of unconstrained end regions 34 extending from coupling structure 26 may be substantially equal. Thus, the dampening member 20 may be substantially centered or cantilevered with respect to a single coupling structure 26. In such a configuration, the unconstrained end regions 34, if substantially identically sized and structured (i.e., substantially congruent), may exhibit substantially similar dampening characteristics, which may be related to a length Lf of each of unconstrained end regions 34. Thus, it may be appreciated that the unconstrained end regions 34 of dampening member 20 extending away from coupling structure 26 may generally vibrate, wobble, twist, or otherwise be displaced in response to vibrations that are communicated or conducted through the mounting region 28 and into region 30 of the base 22. In this way, dampening member 20 may dampen or dissipate vibration that is communicated thereto.

Accordingly, in one aspect of the present invention, a length Lf of unconstrained end regions 34 of dampening member 20 may be selected with respect to a desired damping characteristic. Explaining further, dampening member 20 may exhibit dampening characteristics in relation to a size and configuration of an unconstrained end region 34 of a dampening member 20. Put another way, dampening member 20 may dampen vibrations preferentially in relation to a natural frequency thereof. It may further be appreciated that the nature of the coupling (e.g., relatively tight or loose) of the dampening member 20 to the base 22 via the coupling structure 26 may also influence the dampening behavior thereof. Thus, an assembly of at least one dampening member 20 and at least one coupling structure 26 may be structured for exhibiting, at least one selected natural frequency. The present invention contemplates that such an at least one natural frequency of a dampening member may preferentially dampen or dissipate vibrations from a system that exhibit substantially the at least one natural frequency.

Figure 3:
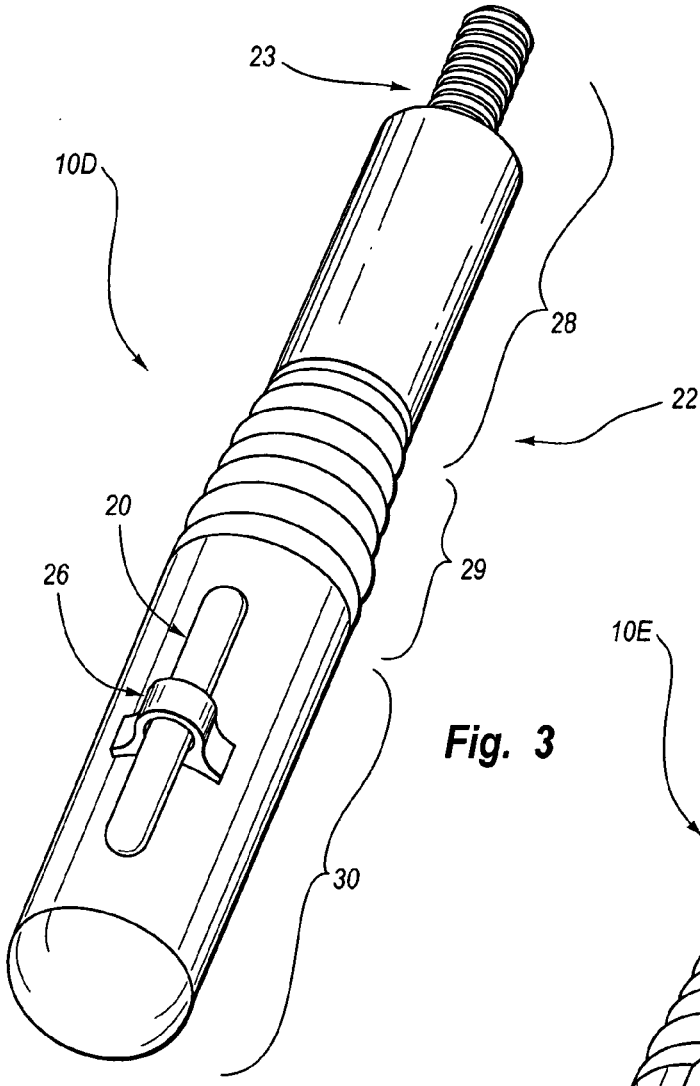
FIGS. 3 shows a perspective view of another embodiment of a dampening apparatus of the present invention.

In another embodiment of an apparatus 10D of the present invention, as shown in FIG. 3, transition region 29 (shown as having a ribbed exterior surface) may comprise a flexible joint. For example, transition region 29 may comprise a pliable, resilient material. Such a configuration may provide dampening ability to apparatus 10C (FIG. 2C), since region 30 (e.g., a mass or rotational inertia), may cause transition region 29 to bend, twist, or otherwise dampen vibrational energy in response to vibrational energy communicated thereto.

Figure 4:
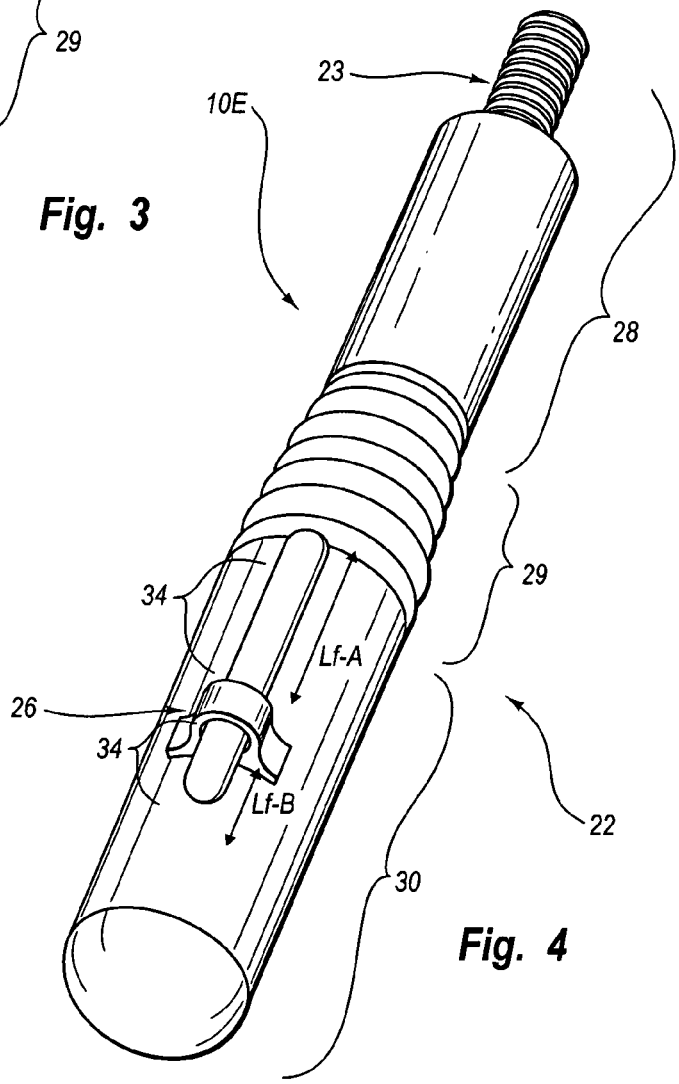
FIGS. 4 shows a perspective view of the dampening apparatus as shown in FIG. 3, wherein the dampening member is positioned differently with respect to the coupling structure.

In an alternative embodiment of the present invention, apparatus 10E, as shown in FIG. 4, may include a dampening member 20 having end regions 34 extending from coupling structure 26, wherein end regions 34 each exhibits different lengths Lf-A and Lf-B, respectively. Put another way, the length L (FIG. 1B) of dampening member 20 may be positioned and cantilevered unequally with respect to coupling structure 26. Such a configuration may be advantageous for forming dampening apparatuses having selected dampening characteristics. More particularly, such unconstrained end regions 34 may exhibit unequal lengths Lf-A and Lf-B, corresponding to selected, different natural frequencies for dampening vibrational energy communicated thereto.

Figure 5:
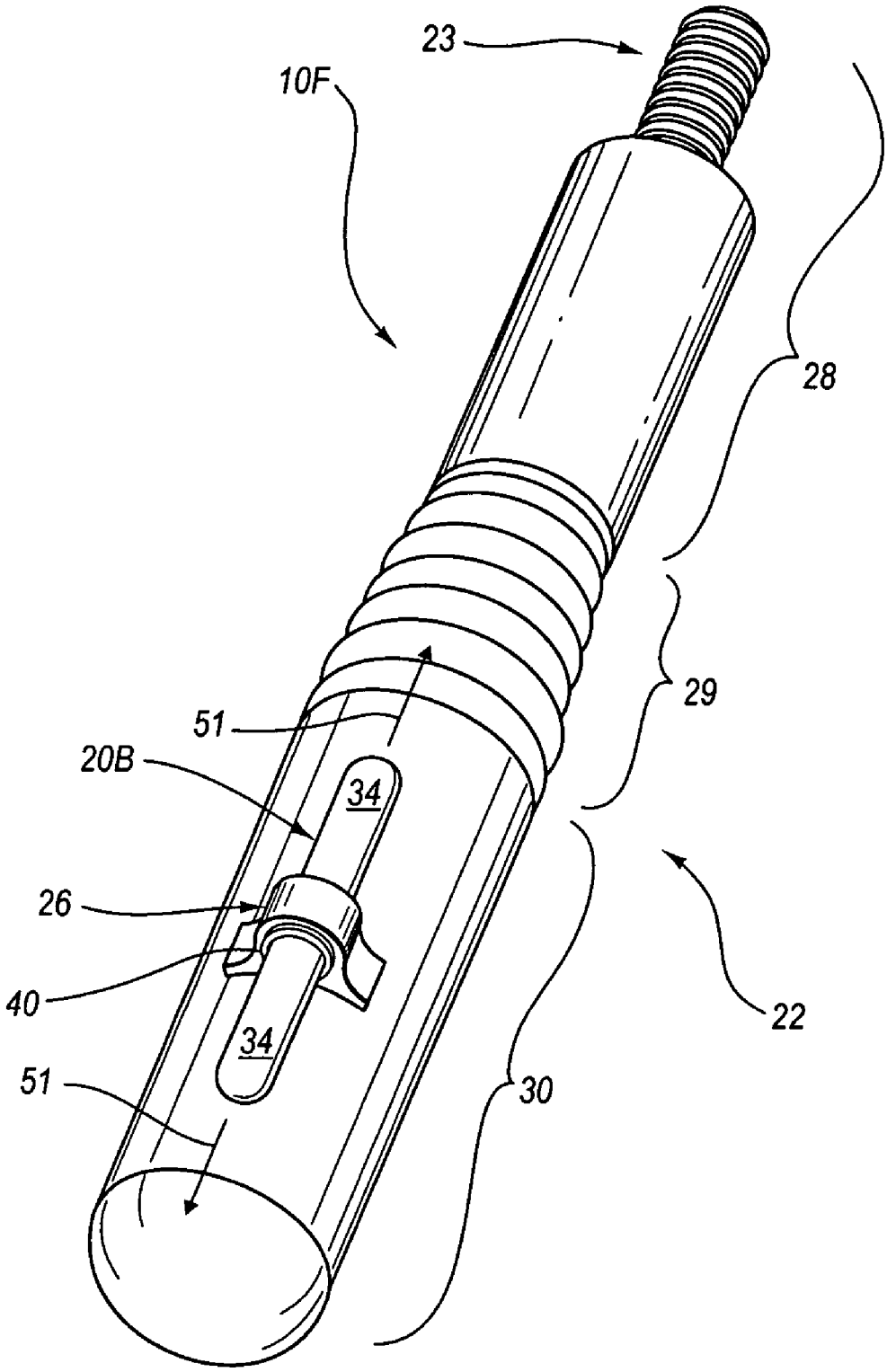
FIG. 5 shows a perspective view of a further embodiment of a dampening apparatus of the present invention.

FIG. 5 shows another embodiment of an apparatus 10F of the present invention including one dampening member 20B having raised retaining elements 40 coupled to the apparatus 10F by way of one coupling structure 26. As shown in FIG. 1B, dampening member 20B may include at least one raised retaining element 40 formed upon at least a portion of a periphery (e.g., at least a portion of a circumference, if dampening member 20B is cylindrical) of the dampening member 20B. More generally, at least one raised retaining element 40 may be structured and positioned for retaining or positioning dampening member 20B with respect to at least one coupling structure 26. Explaining further, a raised retaining element 40 may be sized so that deformation thereof is required for coupling (e.g., displacing into or through) to a coupling structure 26. In one embodiment, for example, raised retaining elements 40 may have an exterior size that exceeds a maximum size of an interior of a coupling structure 26. More generally, an engagement structure may be formed on a dampening member of the present invention and may engage a corresponding feature of a coupling structure. Engagement features or corresponding features may comprise any positioning features as known in the art, such as, for example, protrusions, recesses, so-called "snap-fit" features, or pins, without limitation.

For example, the present invention further contemplates that a raised retaining element 40 of a dampening member 20 may fit into a groove formed on an interior surface of a coupling structure 26. In a further embodiment, wherein more than one coupling structure couples a dampening member to a dampening apparatus, one raised retaining element 40 may be positioned on one side of a coupling structure 26 and another raised retaining element 40 may be positioned on another side of a different coupling structure 26. It should also be appreciated that a single raised retaining element 40 may be sufficient for positioning a dampening member 20. In particular, such a configuration may be desirable where a known force (e.g., an earthly gravitational force) or another particular force or motion may act on the dampening member 20. Such a configuration may facilitate retention and positioning of the dampening member 20B with respect to the coupling structure 26. Put another way, such a configuration may position or hold dampening member 20 with respect to coupling structure 26.

Figure 6:
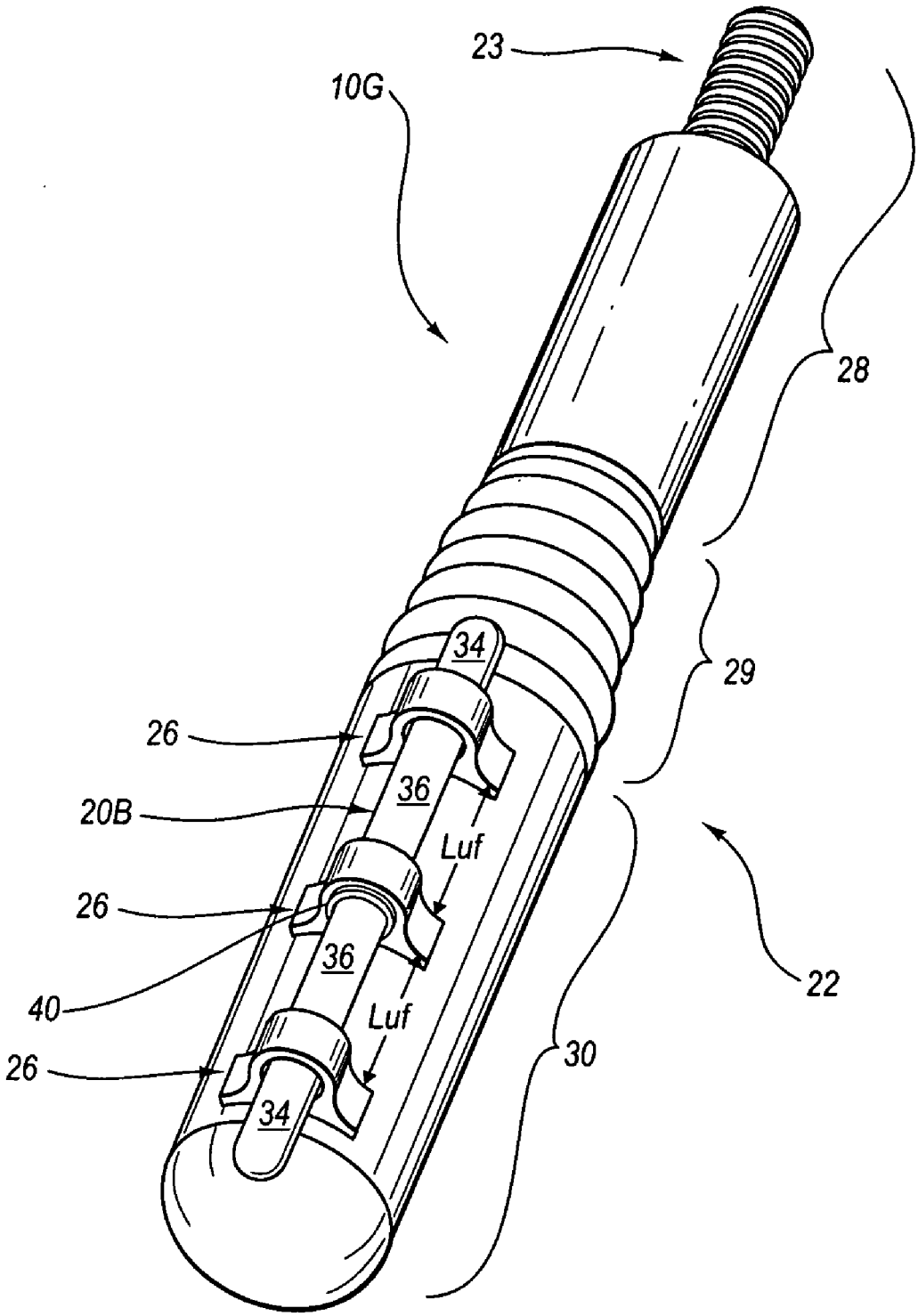
FIG. 6 shows a perspective view of yet another embodiment of a dampening apparatus of the present invention including a plurality of coupling structures.

FIG. 6 shows another embodiment of a dampening apparatus 10G according to the present invention wherein a dampening member 20B may be coupled to a base 22 by a plurality of coupling structures 26. Thus, the dampening member 20B may be supported along the elongated body thereof generally about a plurality of different regions by respective coupling structures 26 to form end regions 34 and middle regions 36. More particularly, the present invention contemplates that the distance between coupling structures 26 may be selectively chosen so as to effectively dampen vibrations. Explaining further, middle regions 36 of dampening member 20 may have a length of Luf and may be configured for exhibiting a selected dampening characteristic. Of course, as described above, end regions 34 may be configured and sized to exhibit a selected dampening characteristic in combination with middle regions 36 or alone, without limitations. Put another way, the present invention contemplates that a length or other aspect such as size, material, etc. of a middle region 36, and end region 34, or both of dampening member 20B may be selected with respect to a desired damping characteristic (e.g., at least one natural frequency). Thus, an assembly of at least one dampening member 20B and at least one coupling structure 26 may be structured for exhibiting at least one selected natural frequency.

In another aspect of the present invention an apparatus (e.g., any of apparatuses 10A-10G as described hereinabove) of the present invention may be coupled to a system, such as without limitation an archery system, for dampening vibrations thereof. Generally, an apparatus with a dampening device according to the present invention may be coupled to any system, without limitation. For example, an apparatus with a dampening device according to the present invention may be coupled to an archery bow, a tennis racket, a baseball bat, or any other system wherein vibration may occur, such as, for example, impact-induced or recoil-induced vibration.

Figure 7A:
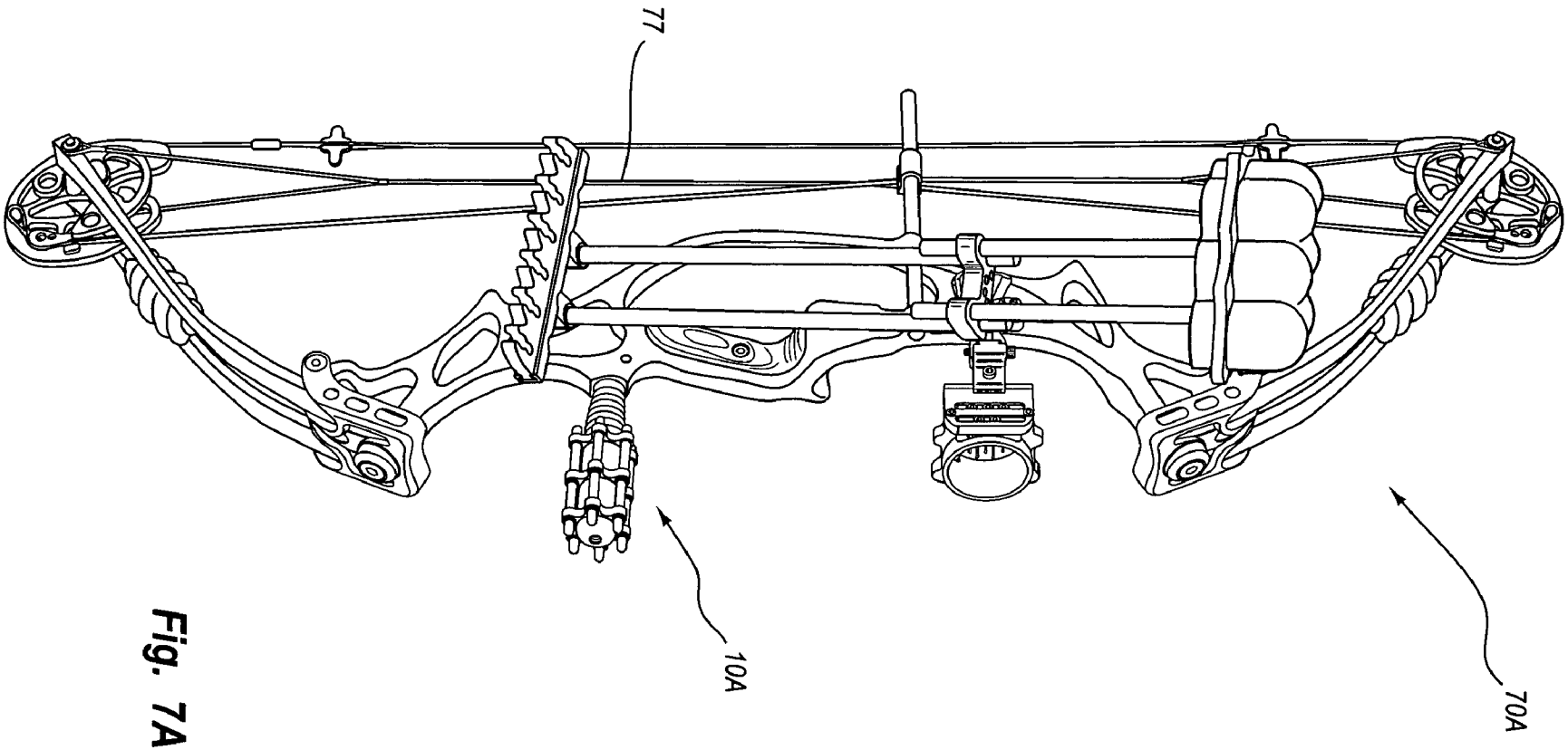
FIG. 7A shows a perspective view of an embodiment of an archery system of the present invention including a dampening apparatus of the present invention.

For example, FIG. 7A shows a perspective view of an archery system 70A including an apparatus 10A comprising a dampening device of the present invention. As shown in FIG. 7A, apparatus 10A may be affixed to the archery bow system 70A. In one embodiment, apparatus 10A may be affixed to archery bow system 70A by threads. In another embodiment, dampening apparatus 10A may be adhesively attached to archery bow system 70A or otherwise mechanically attached thereto, without limitation. The dampening member of apparatus 10A may dampen vibration caused by drawing and releasing bowstring 77. The present invention contemplates that a dampening apparatus may be affixed to any archery bow as known in the art, such as, for instance, compound archery bows, recurve archery bows, or cross bows, without limitation.

In addition and more generally, the present invention contemplates that an elongated dampening apparatus or member comprising a pliable, resilient material may be coupled to a component of a system, the system, or both for dampening or dissipating vibrations. Thus, the present invention contemplates that coupling structures may be affixed to or integrally formed with a system, component, or both. Further dampening members may be coupled to the coupling structures for dampening of vibrations experienced by the system, component, or both.

Figure 7B:
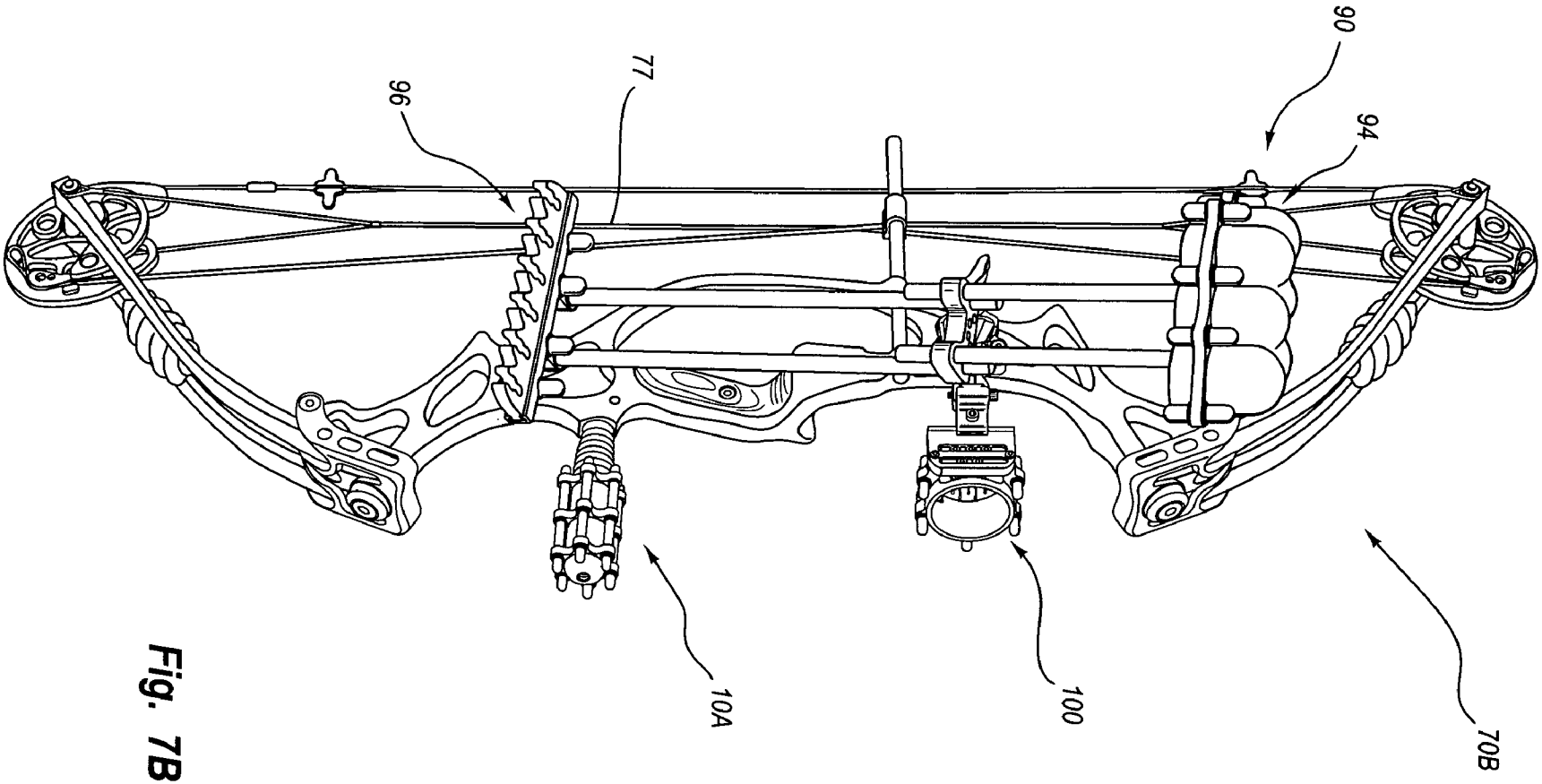
FIG. 7B shows a perspective view of an archery system of the present invention including a dampening apparatus of the present invention and further including a plurality of dampening members coupled to both the quiver and the sighting device.
Figure 7C:
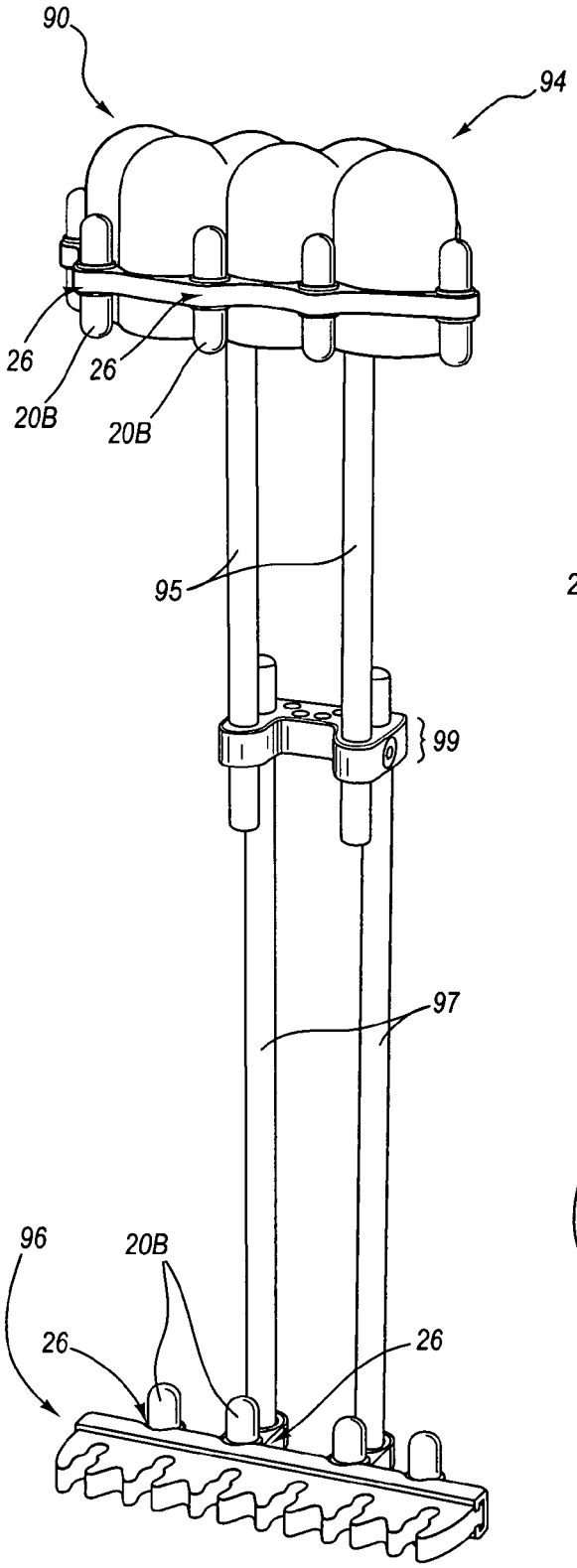
FIGS. 7C and 7D show respective perspective views of the quiver shown in FIG. 7B including a plurality of dampening members.
Figure 7D:
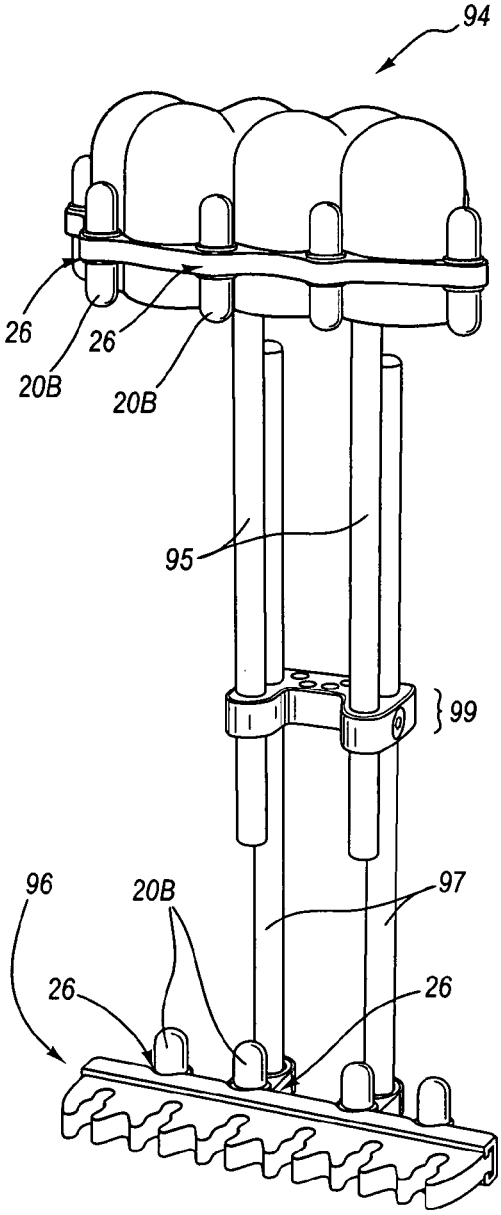

For instance, FIG. 7B shows an archery bow system 70B including a quiver 90 wherein at least one dampening member 20B is coupled thereto. Also, sighting device 100 includes at least one dampening member 20B coupled thereto. Further, FIGS. 7C and 7D show enlarged perspective views of an embodiment of an archery quiver 90 according to the present invention including an upper shell 94 and a lower rack 96. Upper shell 94 may be at least partially filled with a foam and may be configured for accepting arrow points, both broad heads and field points, of a plurality of arrows while lower rack 96 may be flexible and sized and configured for accepting and holding a portion of each respective arrow shaft of a plurality of arrows held therewith, proximate to the fletching (e.g., vanes or feathers). Also, upper shell 94 may be affixed to guide rods 95 and lower rack 96 may be affixed to guide rods 97, wherein guide rods 95 may be coupled to guide rods 97 via coupling device 99. Coupling device 99 may be employed for holding guide rods 95 in relation to guide rods 97; thus, upper shell 94 may be positioned relative to lower rack 96, as illustrated by the different separation distance between upper shell 94 and lower rack 96, as shown in FIGS. 7C and 7D. Accordingly, archery quiver 90 may be adjustable and may accept a relatively wide range of arrow lengths and types of arrows.

Figure 7E:
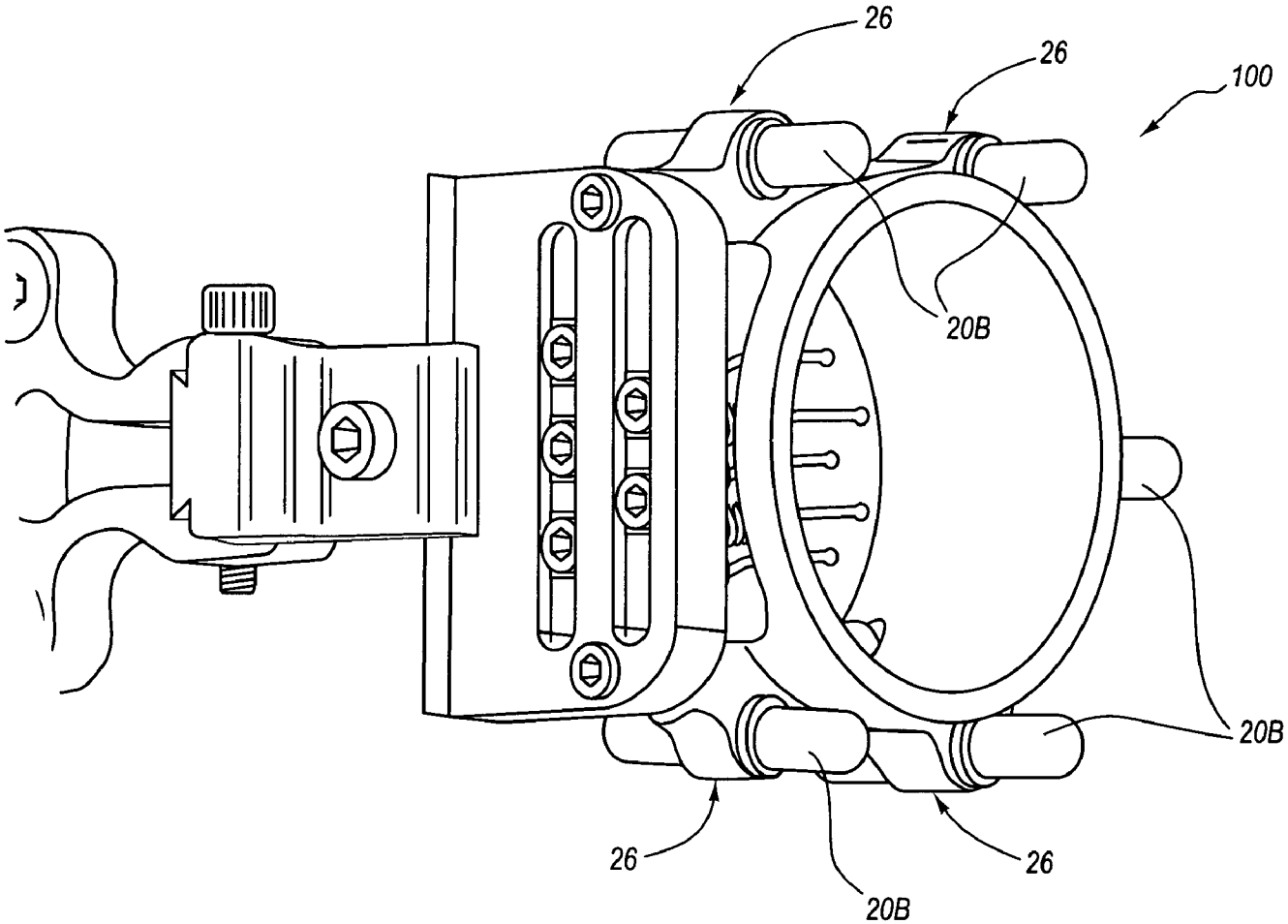
FIG. 7E shows a perspective view of the sighting device shown in FIG. 7B including a plurality of dampening members.

According to the present invention, generally, at least one (i.e., one or both) of upper shell 94 and lower rack 96 may include at least one dampening member 20B. In further detail, archery quiver 90 may include a plurality of coupling structures 26 comprising apertures, as discussed above, wherein each of apertures is sized and configured for accepting therein a dampening member 20B. More particularly, upper shell 94 and lower rack 96 may each include a plurality of coupling structures 26 comprising apertures. As shown in FIG. 7E, coupling structures 26 may be formed integrally with the upper shell 94. In another embodiment, coupling structure 26 may be affixed (e.g., screwed, bolted, riveted, snap-fit, integrally formed, adhesively affixed, etc.) to the upper shell 94, without limitation. Further, as shown in FIG. 7E dampening members 20 may be coupled to upper shell 94 and lower rack 96 via coupling structures 26, respectively. Dampening members 20B may each include raised retaining elements (not labeled, for clarity) for positioning dampening members 20B within apertures 92 of coupling structures 26, respectively. Also, a longitudinal axis (e.g., a longitudinal axis 51 as shown in FIG. 1B) of each of the plurality of dampening members 20B may extend in a straight line. Further, each of dampening members 20B may be substantially parallel to one another (i.e., the longitudinal axes 51 of each of the dampening members 20B may be substantially parallel to one another).

It should be understood that dampening members 20B may be configured in any of the above-discussed embodiments relating to dampening apparatuses 7A, 7B, or 7E, without limitation. Thus, at least one coupling structure 26 may be employed for coupling at least one dampening member 20B to upper shell 94 or lower rack 96, respectively. Also, a longitudinal axis of one or more of the plurality of dampening members 20B or may extend accurately and may be coupled to upper shell 94 via one or more coupling structures 26, without limitation. It may further be appreciated that although the dampening members 20B, as shown in FIGS. 7B, may have a length to nominal diameter ratio (i.e., an aspect ratio) that is smaller than a diameter to length ratio of the dampening members 20 or 20B as shown in FIGS. 1A-6E, as mentioned above, each may be elongated.

Similarly, a sighting device of the present invention may include at least one coupling structure for coupling at least one dampening member thereto. More particularly, as shown in FIG. 7E, sighting device 100 includes a frame member 102 including a plurality of coupling structures 26 comprising apertures, as discussed hereinabove, positioned along at least a portion of the circumference thereof. Frame member 102 may be substantially circular, as shown in FIG. 7E, or may be otherwise configured, without limitation. As known in the art, sighting elements 104 may extend from frame member 102 for use in providing a visual reference for sighting in anticipation of releasing an arrow from a bow system. As shown in FIG. 7E, coupling structures 26 may be formed integrally with the upper shell 94. In another embodiment, coupling structure 26 may be affixed (e.g., screwed, bolted, riveted, snap-fit, integrally formed, adhesively affixed, etc.) to the sighting device 100, without limitation. Further, dampening members 20B may be coupled to sighting device 100 via coupling structures 26, respectively. As shown in FIG. 7E, dampening members 20B may each include at least one raised retaining element 40 for positioning dampening members 20B within apertures 92 of coupling structures 26, respectively. As shown in FIG. 7E, a longitudinal axis (e.g., a longitudinal axis 51 as shown in FIG. 1B) of each of the plurality of dampening members 20B may extend in a straight line. Further, as shown in FIG. 7E, each of dampening members 20B may be substantially parallel to one another (i.e., the longitudinal axes of each of the dampening members 20B may be substantially parallel to one another). It may further be noted that the longitudinal axes of each of the dampening members 20B may be substantially parallel to a longitudinal axis of an arrow positioned for carrying within the quiver.

It should be understood that dampening members 20B may be configured according to any of the above-discussed embodiments relating to dampening apparatuses 10A-10G, without limitation. Thus, a plurality of coupling structures 26 may be employed for coupling one dampening member 20B to sighting device 100. Also, a longitudinal axis of one or more of the plurality of dampening members 20B or may extend accurately, coupled to sighting device 100 via one or more coupling structures 26, without limitation.

In another embodiment, an arrow rest may include at least one coupling structure for coupling at least one dampening member to the arrow rest. As known in the art, an arrow rest is a structure which may be coupled to an archery bow and that is configured to support an arrow during at least a portion of the period when an arrow is nocked on the bowstring and/or is launched. Generally, the present invention contemplates that any arrow rest (e.g., a shoot-through, a shoot-around, or a drop-away arrow rest) may include at least one dampening member, without limitation. For example, FIG. 7F shows an exemplary arrow rest 200 including a housing 202 (i.e., a frame) including a plurality of coupling structures 26 comprising apertures, as discussed hereinabove, positioned along at least a portion of the circumference of the housing 202.

Figure 7F:
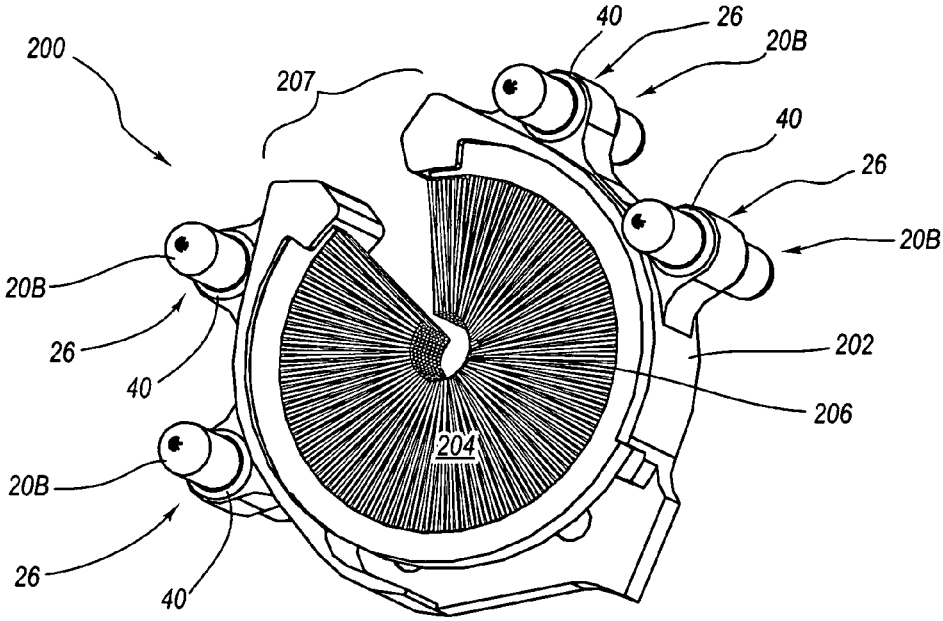
FIG. 7F shows a perspective view of an arrow rest including a plurality of dampening members coupled to the arrow rest.
Figure 7G:
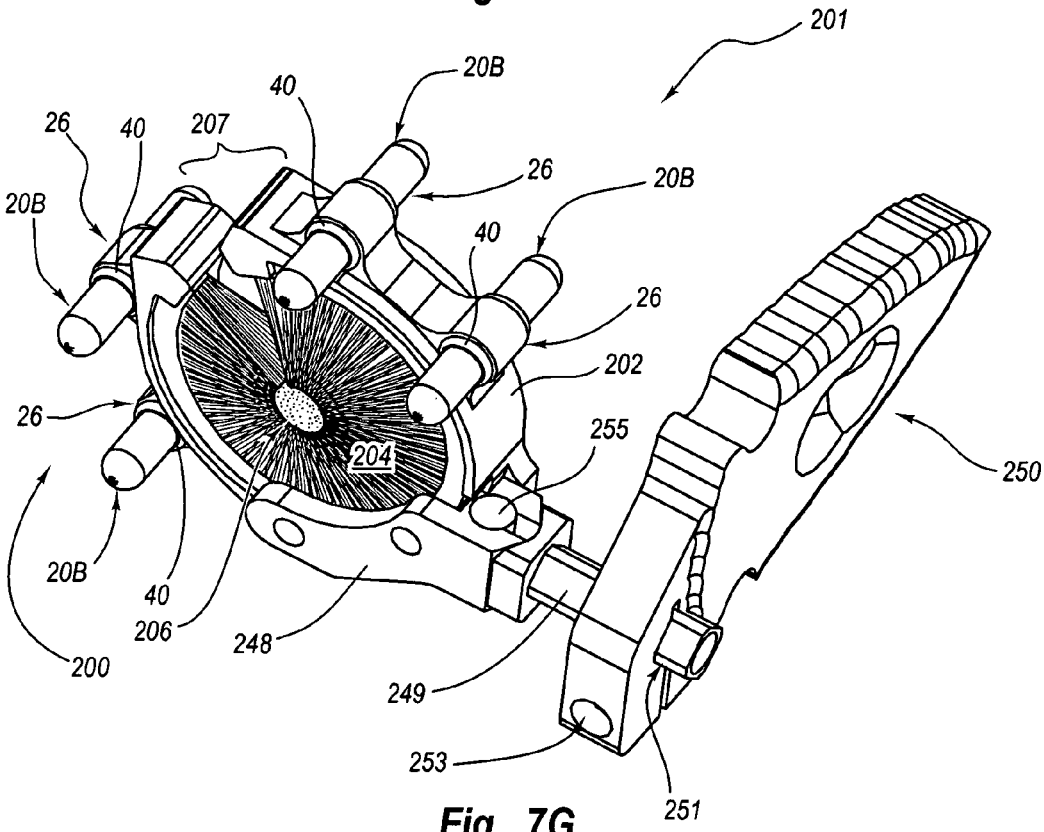
FIG. 7G shows a perspective view of an arrow assembly including an arrow rest as shown in FIG. 7F.

Those skilled in the art will understand that the arrow rest 200 shown in FIGS. 7F and 7G is merely exemplary of the numerous different types of arrow rests with which the present invention may be employed. Housing 202 may be substantially circular (e.g., C-shaped), as shown in FIG. 7F, or may be otherwise configured, without limitation. As known in the art, a rest base 204 in the form of a plurality of individual members (similar to bristles of a paint brush) may be positioned generally within housing 202. Arrow rests of this type, without the dampening device according to the present invention, are sold under the trademark Whisker Biscuit™ by Carolina Archery Products. Housing 202 and rest base 204 may define a slot 207 extending from an outer circumference of the housing 202 toward a central aperture 206 formed through the rest base 204. The structure surrounding central aperture 206 may provide support to an arrow extending through the central aperture 206. As known in the art, slot 207 is optional; in some configurations, rest base 204 may include only aperture 206. As mentioned, the present invention contemplates that any arrow rest, as known in the art, may include at least one dampening member coupled to the arrow rest, without limitation. As shown in FIG. 7F, coupling structures 26 may be formed integrally with the housing 202, if desired. In another embodiment, coupling structure 26 may be affixed (e.g., screwed, bolted, riveted, snap-fit, integrally formed, adhesively affixed, etc.) to the housing 202 of the arrow rest, without limitation. Thus, dampening members 20B may be coupled to the arrow rest 200 via coupling structures 26, respectively. As shown in FIG. 7F, dampening members 20B may each optionally include at least one raised retaining element 40 for positioning dampening members 20B within each of coupling structures 26, respectively. As shown in FIG. 7F, a longitudinal axis (e.g., a longitudinal axis 51 as shown in FIG. 1B) of each of the plurality of dampening members 20B may extend in a straight line. Further, as shown in FIG. 7F, each of dampening members 20B may be substantially parallel to one another (i.e., the longitudinal axes of each of the dampening members 20B may be substantially parallel to one another). It may further be noted that each of the longitudinal axes of the dampening members 20B may be substantially parallel to a longitudinal axis of an arrow extending through (e.g., positioned within the aperture 206 of) the rest base 204. Of course, such an arrow rest may be incorporated within an arrow rest assembly configured for ease in coupling to an archery system. For example, in one embodiment, arrow rest 200 may be incorporated within arrow rest assembly 201, as shown in FIG. 7G. In further detail, arrow rest 200 may be coupled to a housing base 248, a horizontal adjustment arm 249, and a plate member 250. As shown in FIG. 7G, a portion of horizontal adjustment arm 249 may be positioned and affixed within recess 251 at a selected position, as known in the art. Further, a fastening element may be positioned within bore 253 to secure the arm 249 in a desired horizontal position. An intermediate coupling lug 255 may be positioned within housing base 248 to adjust the vertical position of housing base 248. Of course, as known in the art, plate member 250 may include at least one recess or hole (e.g., a plurality of recesses arranged in a substantially rectangular pattern) configured for affixing the arrow rest assembly 201 to a riser of an archery bow.

Further, it should be understood that dampening members 20B as shown in FIGS. 7F and 7G may be configured according to any of the above-discussed embodiments relating to dampening apparatuses 10A-10G, without limitation. Thus, a plurality of coupling structures 26 may be employed for coupling one dampening member 20B to arrow rest 200, if desired. Also, a longitudinal axis of one or more of the plurality of dampening members 20B may extend accurately and may be coupled to arrow rest 200 via one or more coupling structures 26, without limitation.

While certain embodiments and details have been included herein and in the attached invention disclosure for purposes of illustrating the invention, it will be apparent to those skilled in the art that various changes in the methods and apparatus disclosed herein may be made without departing form the scope of the invention, which is defined in the appended claims.

What is claimed is:

1. A structure for dampening vibrational energy from a system, comprising:

a base mounted to the system;

at least one dampening member including an elongated body comprising a resilient, pliable material; and at least one coupling structure structured for coupling at least a middle portion of the elongated body of the at least one dampening member to an exterior of the base;

wherein end regions of the elongated body extend in opposite directions from the coupling structure, and wherein at least a portion of each end portion is cantilevered and not in contact with any structure;

at least one rib extending radially from the elongated body to hold the dampening member to the base.

2. The structure of claim 1, wherein the at least one coupling structure substantially equally divides the at least one dampening member into two unconstrained end regions.

3. The structure of claim 1, wherein the system comprises an archery bow.

4. The structure of claim 3, wherein the structure is located on at least one of a quiver, a sighting mechanism, and an arrow rest.

5. The structure of claim 1, wherein the at least one coupling structure is structured for causing at least one of compression, pinching, and constraining of the at least one dampening member.

6. The structure of claim 1, wherein the at least one dampening member has an exterior size that exceeds a maximum size of an interior of the at least one coupling structure.

7. The structure of claim 6, wherein the at least one coupling structure comprises at least one aperture.

8. A structure for dampening vibrational energy from a system, comprising:

a base mounted to the system;

at least one dampening member including an elongated body comprising a resilient, pliable material, wherein at least a portion of the at least one dampening member extends along an arcuate path; and at least one coupling structure structured for coupling at least a portion of the elongated body of the at least one dampening member to an exterior of the base;

wherein end regions of the elongated body extend in opposite directions from the coupling structure, and wherein at least a portion of each end portion is cantilevered and not in contact with any structure.

9. A structure for dampening vibrational energy from a system, comprising:

at least one dampening member including a elongated body comprising a resilient, pliable material, the elongate body having a length dimension that is at least two times larger than a maximum cross-sectional dimension taken perpendicular to the length dimension; and at least one coupling structure structured for coupling at least a portion of the elongated body of the at least one dampening member to the system;

wherein the at least one dampening member is coupled to the system via the at least one coupling structure wherein:

the at least one elongated dampening member comprises a plurality of dampening members; and the at least one coupling structure comprises a plurality of coupling structures;

wherein a longitudinal axis of one of the plurality of dampening members is substantially parallel with respect to the other.

10. The structure of claim 9, wherein:

the at least one dampening member includes at least one unconstrained middle region extending between adjacent coupling structures of the plurality of coupling structures.

11. The structure of claim 9, wherein each of the plurality of dampening members further comprises at least one raised retaining element extending about at least a portion of a periphery of the at least one dampening member.

12. The structure of claim 9, wherein the structure is located on a quiver, wherein a longitudinal axis of each of the plurality of dampening members is substantially aligned with a longitudinal axis of an arrow positioned within the quiver.

13. The structure of claim 9, wherein at least a portion of at least one dampening member of the plurality of dampening members extends along an arcuate path.

14. An apparatus for dampening vibrational energy from a system, comprising:

a base having a first end and a second end, the first end including an attachment mechanism for affixing the apparatus to the system;

at least one dampening member including an elongated body comprising a resilient, pliable material; and at least one coupling structure structured for coupling at least a middle portion of the elongated body of the at least one dampening member to an exterior of the base;

wherein end regions of the elongated body extend in opposite directions from the coupling structure, and wherein at least a portion of each end portion is cantilevered and not in contact with any structure;

at least one rib extending radially from the elongated body to hold the dampening member to the base.

15. The apparatus of claim 14, wherein the at least one coupling structure, upon coupling of the at least one dampening member to the system, forms two substantially congruent, unconstrained end regions.

16. The apparatus of claim 14, wherein the system comprises an archery bow.

17. The apparatus of claim 14, wherein the at least one coupling structure is structured for causing at least one of compression, pinching, and constraining of the at least one dampening member.

18. The apparatus of claim 14, wherein the at least one dampening member has an exterior size that exceeds a maximum size of an interior of the at least one coupling structure.

19. The apparatus of claim 18, wherein a plurality of dampening members are positioned symmetrically about a circumference of the base.

20. The apparatus of claim 18, wherein the at least one coupling structure comprises at least one aperture for surrounding a portion of a periphery of the at least one dampening member.

21. The apparatus of claim 14, wherein the attachment mechanism is a threaded element.

22. An apparatus for dampening vibrational energy from a system, comprising:

a base having a first end and a second end, the first end including an attachment mechanism for affixing the apparatus to the system, a transition region positioned between the first end and the second end of the base, wherein the transition region comprises a resilient, pliable material;

at least one dampening member including an elongated body comprising a resilient, pliable material; and at least one coupling structure structured for coupling at least a portion of the elongated body of the at least one dampening member to an exterior of the base;

wherein end regions of the elongated body extend in opposite directions from the coupling structure, and wherein at least a portion of each end portion is cantilevered and not in contact with any structure.

23. An apparatus for dampening vibrational energy from a system, comprising:

a base having a first end and a second end, the first end including an attachment mechanism for affixing the apparatus to the system;

at least one dampening member including an elongated body comprising a resilient, pliable material, wherein the at least one dampening member includes at least one unconstrained middle region extending between adjacent coupling structures of the plurality of coupling structures;

at least one coupling structure structured for coupling at least a portion of the elongated body of the at least one dampening member to an exterior of the base, wherein the at least one coupling structure comprises a plurality of coupling structures; and wherein end regions of the elongated body extend in opposite directions from the coupling structure, and wherein at least a portion of each end portion is cantilevered and not in contact with any structure.

24. An apparatus for dampening vibrational energy from a system, comprising:

a base having a first end and a second end, the first end including an attachment mechanism for affixing the apparatus to the system;

at least one dampening member including an elongated body comprising a resilient, pliable material, wherein the at least one dampening member is coupled to the base via a plurality of coupling structures; and at least one coupling structure structured for coupling at least a portion of the elongated body of the at least one dampening member to an exterior of the base;

wherein end regions of the elongated body extend in opposite directions from the coupling structure, and wherein at least a portion of each end portion is cantilevered and not in contact with any structure.

25. An apparatus for dampening vibrational energy from a system, comprising:

a base having a first end and a second end, the first end including an attachment mechanism for affixing the apparatus to the system;

at least one dampening member including an elongated body comprising a resilient, pliable material, wherein at least a portion of the at least one dampening member extends along an arcuate path; and at least one coupling structure structured for coupling at least a portion of the elongated body of the at least one dampening member to an exterior of the base;

wherein end regions of the elongated body extend in opposite directions from the coupling structure, and wherein at least a portion of each end portion is cantilevered and not in contact with any structure.

26. An apparatus for dampening vibrational energy from a system, comprising:

a base having a first end and a second end, the first end including an attachment mechanism for affixing the apparatus to the system;

at least one dampening member including an elongated body comprising a resilient, pliable material, wherein the at least one elongated dampening member comprises a plurality of dampening members; and at least one coupling structure structured for coupling at least a portion of the elongated body of the at least one dampening member to an exterior of the base, wherein the at least one coupling structure comprises a plurality of coupling structures;

wherein end regions of the elongated body extend in opposite directions from the coupling structure, and wherein at least a portion of each end portion is cantilevered and not in contact with any structure.

27. The apparatus of claim 26, wherein the plurality of dampening members are positioned symmetrically about a circumference of the base.

28. The apparatus of claim 26, each of the plurality of dampening members is coupled to the base by way of a plurality of substantially aligned, cylindrical apertures.

29. The apparatus of claim 28, wherein each of the plurality of dampening members further comprises at least one raised retaining element extending about at least a portion of a periphery of the at least one dampening member.

30. The apparatus of claim 26, wherein a longitudinal axis of each of the plurality of dampening members is substantially parallel with respect to one another.

31. The apparatus of claim 26, wherein at least a portion of at least one dampening member of the plurality of dampening members extends along an arcuate path.

32. An archery system, comprising:

an archery bow; and a structure for dampening vibrational energy, the structure comprising:

a base mounted to the archery bow;

at least one dampening member including a elongated body comprising a resilient, pliable material; and at least one rib extending radially from the elongated body to hold the dampening member to the base;

at least one coupling structure structured for accepting at least a middle portion of the elongated body of the at least one dampening member so as to couple the middle portion of the at least one dampening member to an exterior of the base;

wherein end regions of the elongated body extend in opposite directions from the coupling structure, and wherein at least a portion of each end portion is cantilevered and not in contact with any structure.

33. The structure of claim 32, further comprising at least one of the following: a quiver, a sighting mechanism, and an arrow rest affixed to the archery system.

34. The archery system of claim 33, wherein the at least one dampening member is coupled to at least one of the quiver, the sighting mechanism, and the arrow rest.

35. The archery system of claim 34, wherein the at least one dampening member is coupled to a dampening apparatus having a base extending between a first end and a second end thereof, respectively, wherein the first end includes an attachment mechanism for affixing the dampening member to the archery bow.

36. An archery system, comprising:

an archery bow including:

at least one dampening member including a elongated body comprising a resilient, pliable material; and at least one coupling structure structured for accepting at least a portion of the elongated body of the at least one dampening member so as to couple the at least one dampening member to the archery bow;

wherein the at least one dampening member is coupled to the archery bow via the at least one coupling structure wherein:

the at least one elongated dampening member comprises a plurality of dampening members; and the at least one coupling structure comprises a plurality of coupling structures;

wherein each of the plurality of dampening members further comprises at least one raised retaining element extending about at least a portion of a periphery of the at least one dampening member.

37. The apparatus of claim 36, wherein the archery bow further comprises a base mounted to the archery bow, and the plurality of coupling structures are coupled to the base, wherein the plurality of dampening members are positioned symmetrically about a circumference of the base.

38. The apparatus of claim 36, wherein the archery bow further comprises a base mounted to the archery bow, and each of the plurality of dampening members is coupled to the base by way of a plurality of substantially aligned, cylindrical apertures.

39. The apparatus of claim 36, wherein the archery bow further comprises a base mounted to the archery bow, and the plurality of dampening members are positioned symmetrically about a circumference of the base.

40. The apparatus of claim 36, wherein a longitudinal axis of each of the plurality of dampening members are substantially parallel with respect to one another.

41. The apparatus of claim 36, wherein at least a portion of at least one dampening member of the plurality of dampening members extends along an arcuate path.

* * * * *